United States Patent [19]

Weinrich

[11] Patent Number: 5,033,090

[45] Date of Patent: Jul. 16, 1991

[54] HEARING AID, ESPECIALLY OF THE IN-THE-EAR TYPE

[75] Inventor: Soren Weinrich, Espergaerde, Denmark

[73] Assignee: Oticon A/S, Denmark

[21] Appl. No.: 577,069

[22] Filed: Sep. 4, 1990

Related U.S. Application Data

[63] Continuation of Ser. No. 322,387, Mar. 13, 1989, abandoned.

[30] Foreign Application Priority Data

Mar. 18, 1988 [DK] Denmark ..... 1479/88

[51] Int. Cl.[5] ..... H04R 25/00

[52] U.S. Cl. ..... 381/68.4; 381/68.6; 381/93

[58] Field of Search ..... 381/68, 68.4, 68.6, 381/69, 83, 93, 94

[56] References Cited

U.S. PATENT DOCUMENTS

| | | | |
|---|---|---|---|
| 3,763,333 | 9/1981 | Lichowsky | 381/68 |
| 4,291,203 | 10/1973 | Bellafiore | 381/68 |
| 4,455,675 | 6/1984 | Bose et al. | 381/74 |
| 4,456,795 | 6/1984 | Saito | 381/68 |
| 4,731,850 | 3/1988 | Levitt et al. | 381/68.4 |
| 4,837,829 | 6/1989 | Lobb | 381/83 |

FOREIGN PATENT DOCUMENTS

| | | | |
|---|---|---|---|
| 2854912 | 6/1979 | Fed. Rep. of Germany . | |
| 2808516 | 9/1979 | Fed. Rep. of Germany . | |
| 3526591 | 1/1987 | Fed. Rep. of Germany . | |
| 0387718 | 3/1980 | Japan | 381/93 |

*Primary Examiner*—Forester W. Isen
*Assistant Examiner*—M. Nelson McGeary, III
*Attorney, Agent, or Firm*—Larson & Taylor

[57] ABSTRACT

In a hearing aid with a microphone, an amplifier and a receiver supplying amplified sound to the user, a second signal path is provided comprising a second, feedback-suppressing microphone, placed at a location to receive feedback-causing sound from the receiver. The output of second provided microphone is suitably attenuated and delayed by an amount $\Delta t$ corresponding to the effective acoustical distance $a+b$ between the second microphone and the main microphone and supplied to a difference amplifier in opposition to the signal from the main microphone. Thus, the component of the signal from the main microphone likely to cause positive feedback or "howling" is substantially cancelled out. In another embodiment, the feedback-suppressing signal path is an acoustical path comprising a tube leading to a rear cavity in a microphone of the directional or differential type.

11 Claims, 2 Drawing Sheets

HEARING AID, ESPECIALLY OF THE IN-THE-EAR TYPE

This application is a continuation, of application Ser. No. 07/322,387 filed 3/13/89, now abandoned.

TECHNICAL FIELD

The present invention relates to a hearing aid of the kind set forth in the preamble of claim 1.

BACKGROUND ART

In many types of hearing aid, especially those of the in-the-ear type, sound from the receiver intended for the user's sound-sensitive organ may reach the microphone along an acoustical transmission path, the length and attenuation of which is so low, that positive acoustical feedback or "howling" may occur. This is especially the case with hearing aids of the in-the-ear type with a vent canal communicating the external auditory meatus with the atmosphere, as the sound from the receiver issuing into the meatus may be propagated along the vent canal and through the atmosphere to the microphone situated at a comparatively short distance from the vent canal.

Several attempts have been made or proposed to reduce the risk of positive acoustical feedback, but up to the present, none of these attempts have proved successful. Thus, attempts have been made by partly or completely occluding the vent canal, by introducing various filters, phase shifts and/or time delays or even negative feedback in the amplifying path, but all these attempts have led to discomfort to the user and/or reduced intelligibility of the speech processed by the hearing aid.

DISCLOSURE OF THE INVENTION

It is the object of the present invention to provide a hearing aid of the kind referred to initially, in which the risk of positive acoustical feedback causing "howling" is eliminated or at least substantially reduced, and this object is attained in a hearing aid also exhibiting the features set forth in the characterizing clause of claim 1. With this arrangement, that part of the sound from the receiver reaching the input to the amplifier is cancelled out by an equal and opposite "anti-sound" from the additional signal path, so that only that component of the signal reaching the amplifier caused by ambient sound to be amplified is effectively transmitted to the user's soundsensitive organ.

Further embodiments of the hearing aid according to the invention, the technical effects of which are explained in the following detailed portion of the present specification, are set forth in the claims 2 to 8.

BRIEF DESCRIPTION OF THE DRAWINGS

The invention will now be explained in more detail with reference to the accompanying, in parts highly diagrammatic drawings, in which.

DESCRIPTION OF THE PREFERRED EMBODIMENTS

Figure 1:
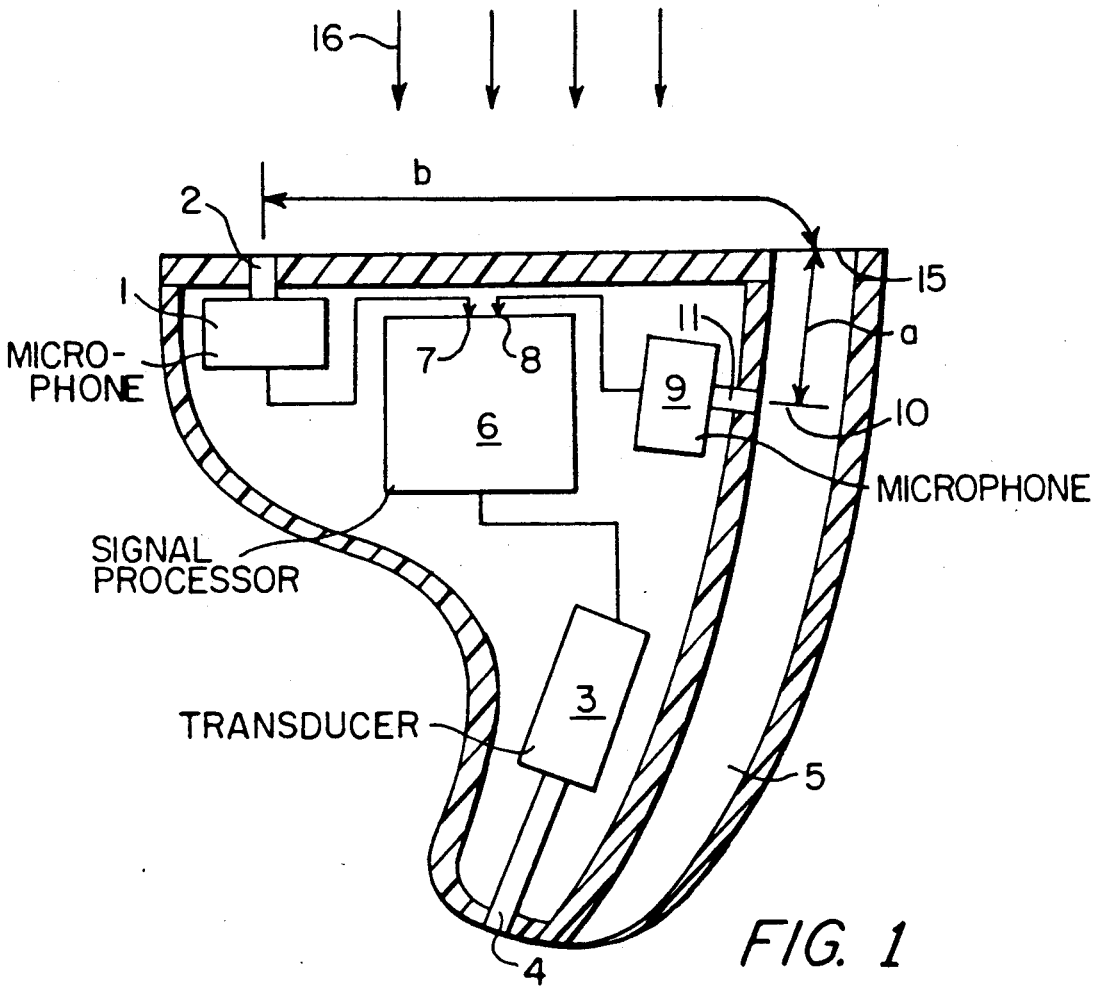
FIG. 1 is a section through a first embodiment.
Figure 3:
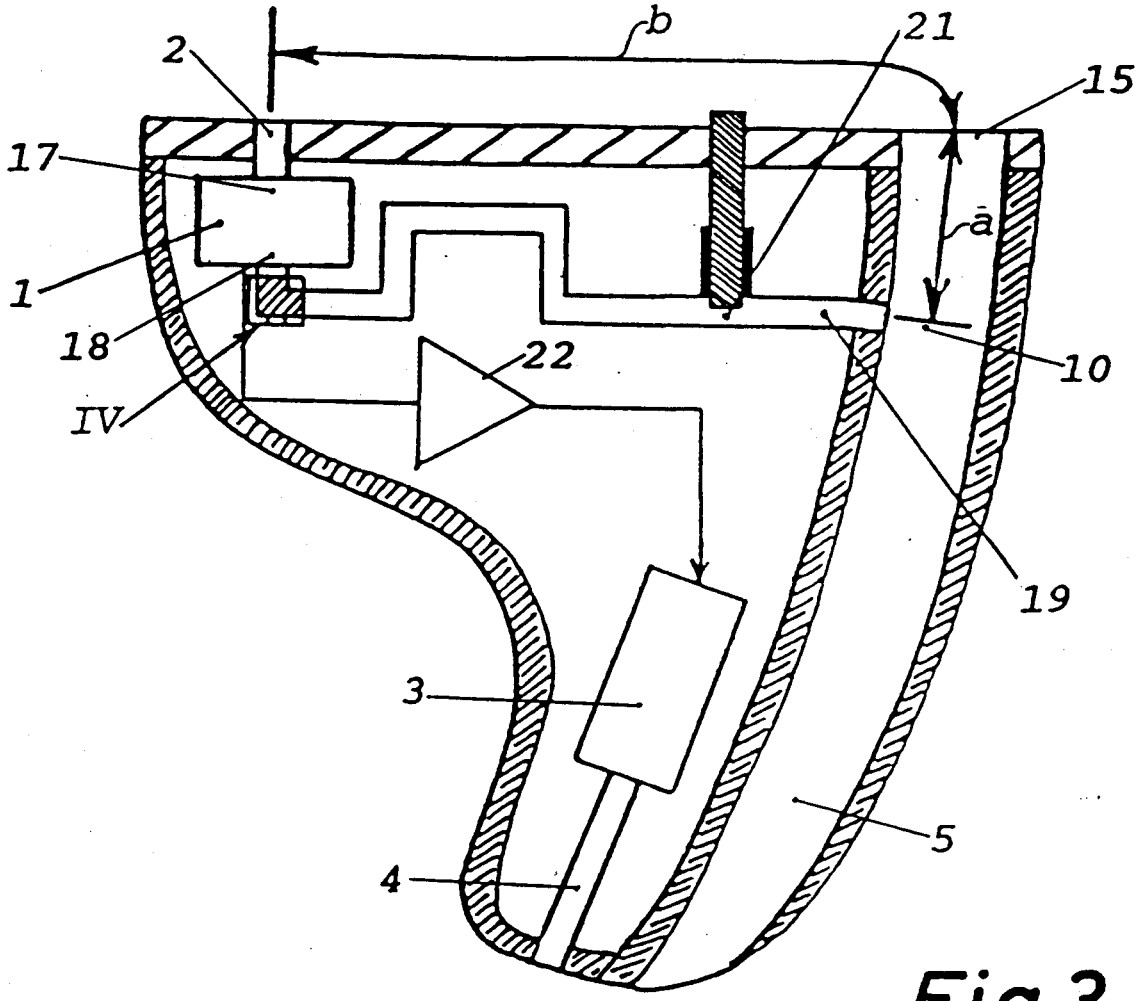
FIG. 3 is a section through a second embodiment.

As may be seen from FIGS. 1 and 3, the exemplary embodiments of the hearing aid according to the invention shown constitute hearing aids of the so-called in-the-ear (ITE) type in the form of a plug-shaped device adapted to be inserted into the external auditory meatus (not shown) of the user. In a manner known per se, both the embodiments shown comprise a microphone 1 connected to the surrounding atmosphere through a duct 2, an electro-acoustic transducer or receiver 3, connected to the part of the user's external auditory meatus proximal of the hearing aid through a duct 4, a vent canal 5 establishing permanent communication between said part of the auditory meatus and the surrounding atmosphere, and equipment to be described below for transmitting and amplifying signals from the microphone 1 to the receiver 3.

Figure 2:
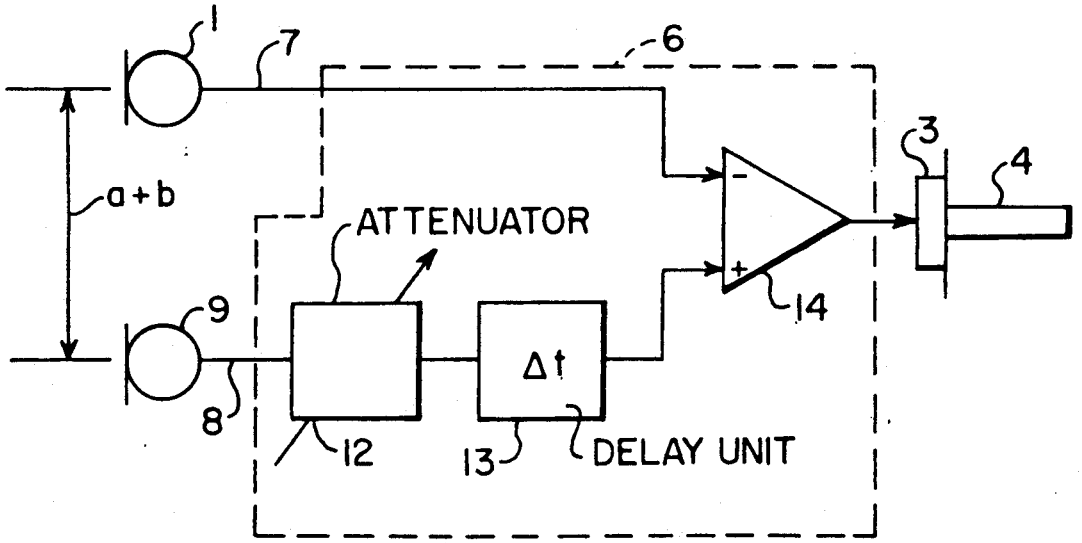
FIG. 2 is a block diagram of the circuit components of the embodiment shown in FIG. 1.

In the embodiment illustrated in FIGS. 1 and 2, the equipment transmitting and amplifying signals from the microphone 1 to the receiver 3 comprises an electronic signal processor 6, the output of which is connected to the receiver 3 and a first input 7 of which is connected to the microphone 1 adapted to receive sound through the surrounding atmosphere. In what follows, the microphone 1 will be described as the "main microphone".

In addition to said first input 7, the signal processor 6 also comprises a second input 8 receiving signals from a second, feedback-suppressing microphone 9 adapted to receive sound from a location 10 in the vent canal 5 through a duct 11.

The second input 8 is connected to the input of a variable attenuator 12, the output of which is connected to a delay unit 13, the latter in turn through its output being connected to the positive input of a difference amplifier 14, the other, negative input of which is connected to the first input 7 receiving signals from the main microphone 1. The output of the difference amplifier 14 is connected to the receiver 3 —directly in the embodiment shown, but this connection could also include amplifying filtering and/or other signal processing equipment.

The location 10, i.e. the location of the duct 11 leading to the second microphone 9 in the vent canal 5, is placed at a distance "a" from the external opening 15 of the vent canal 5, and this opening 15 is situated at a distance "b" from the duct 2 leading to the main microphone 1. Thus, sound from the location 10 to the duct 2 will have to travel through a distance a+b.

The delay unit 13 shown in FIG. 2 is adapted to delay the signal from the attenuator 12 through the difference amplifier 14 by an amount $\Delta t$ corresponding to the time required for sound to travel through the above-mentioned distance a+b. When the hearing aid shown is in operation, some of the sound emerging from the duct 4 of the receiver 3 will unavoidably "leak" through the vent canal 5 to the external opening 15, and of the sound in this manner emerging through the external opening 15, a portion will reach the duct 2 and hence the main microphone 1. In the absence of the second, feedback-suppressing microphone 9 and its associated circuitry components, i.e. the attenuator 12, the delay unit 13 and the "positive part" of the difference amplifier 14, this could lead to a positive feedback condition or "howling". This situation is, however, avoided by means of the microphone 9 and its associated equipment mentioned. At the same time as the "leaking" sound from the receiver 3 passes through the air from the location 10 to the duct 2 of the main microphone 1, the sound detected by the microphone 9 at the location 10 will be converted into an electrical signal, attenuated in the attenuator 12, delayed in the delay unit 13 by the above-mentioned amount Δt and delivered to the positive input of the difference amplifier 14. By suitable adjustment of the attenuator 12 and the delay unit 13, the signal from the latter will be received at the positive input of the difference amplifier 14 with the same amplitude and phase as the signal from the main microphone 1 supplied to the negative input for which reason the signal from the delay unit 13 will cancel-out that component of the signal from the main microphone 1 arising from sound received from the receiver 3 as described above. Thus the output of the difference amplifier 14 will only contain signals from the main microphone 1 arising from ambient sound 16 received. A minor portion of the ambient sound 16 will, of course, be detected by the second microphone 9, but due to the attenuation and/or delay introduced in the signals from the second microphone 9, this will not be able to cause any cancelling-out of the ambient sound signals in the microphone 1.

It can be shown that the frequency response of the hearing aid shown in FIGS. 1 and 2, defined as the difference between the sound pressure level generated by the receiver 3 in the auditory meatus and the free-field sound-pressure level of the ambient sound 16, is modified by the following amount:

$$\Delta_{FF}=20 \log_{10}(1-10^{H(a+b)/20}),$$

where H(a+b) is the acoustical attenuation between the location 10 in the vent canal and the duct 2 leading to the main microphone 1.

This attenuation is practically frequency-independent for frequencies below 6 to 7 kHZ and only dependent on the distance (a+b). As a consequence, the frequency response of the hearing aid is only changed by a frequency-independent quantity, which means that the shape of the frequency response curve is preserved and no high-frequency gain is lost.

Figure 4:
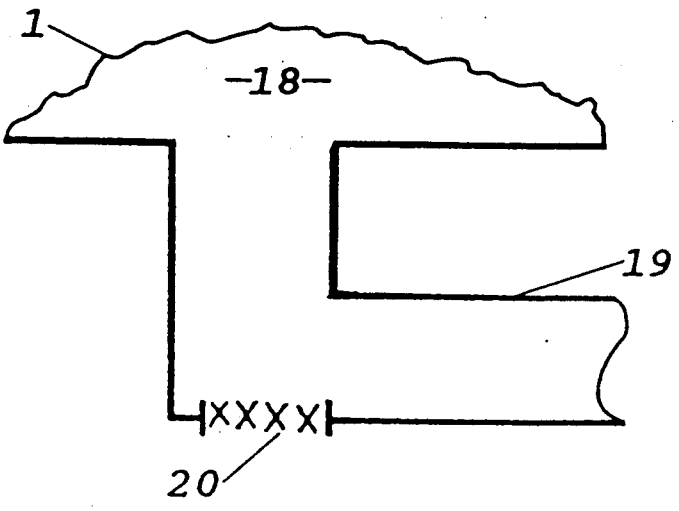
FIG. 4 is a greatly enlarged partial view of the region marked IV in FIG. 3.

In the exemplary embodiment illustrated in FIGS. 3 and 4, reference numbers and characters similar to those in FIGS. 1 and 2 refer to components having—at least in general—the same function as such components shown in FIGS. 1 and 2, for which reason these components will only be described in detail to the extend necessary for describing and explaining the functioning of the embodiment shown in FIGS. 3 and 4.

In the embodiment illustrated in FIGS. 3 and 4, the microphone 1 is of the type having a front cavity 17 and a rear cavity 18, the arrangement being such that sound received by the front cavity 17 causes the generation of microphone output signals opposite in phase to the signals generated due to sound received by the rear cavity 18. Such microphones are known as "directional" or "differential" microphones. In this exemplary embodiment, the feedback-suppressing connection between the location 10 in the vent canal 5 and the microphone 1 is constituted by a tube 19, slightly convoluted so as to have an effective acoustical length equivalent to the acoustical length of the distance a+b. The output end of the tube 19 is connected to the rear cavity 18 of the microphone 1, the connection preferably including an acoustic termination impedance 20, shown in FIG. 4, to avoid reflections at the point of entry to the rear cavity 18, i.e. to enable a free, progressive sound wave to travel through the tube 19.

As the effective acoustical length of the tube 19 is equivalent to the effective acoustical distance from the location 10 to the external duct 2 of the microphone 1, the sound transmitted from the location 10 to the microphone 1 will be delayed by the same amount in the two paths referred to, and by adjusting an acoustic valve 21 placed in the tube 19 it is possible to attain substantially complete suppression of feedback caused by the acoustic connection between the receiver 3 and the microphone 1.

An amplifier 22, that may be of the type conventional to this technology, amplifies the net electrical signals from the microphone 2 and transmits them to the receiver 3 in the conventional manner.

Persons skilled in this art may make numerous modifications to a hearing aid according to the present invention without exceeding the scope of the invention as set forth in the accompanying claims. Thus, the principle of the invention may also be applied to other types of hearing aid than the one shown, such as e.g. a hearing aid partly worn behind the ear. The tube 19 shown in FIG. 3 may have other shapes than the one shown; it may e.g. be wound in a helix or spiral or bent in zig-zag with "soft" curves, or have other shapes capable of giving the tube 19 or a duct equivalent thereto the requisite effective acoustical length.

The active components, such as the difference amplifier 14 shown in FIG. 2 and the straight amplifier 22 shown in FIG. 3, possibly also the attenuator 12 and the delay unit 13, may be powered by suitable batteries (not shown). In the case of two microphones as shown in FIGS. 1 and 2 it is preferred that both microphones are of the same general type, i.e. either pressure-sensitive or velocity-sensitive.

I claim:

1. In a hearing aid comprising a microphone for receiving ambient sound and for producing, on a main signal path, electrical signals corresponding thereto for subsequent amplification, an electro-acoustical transducer for receiving said signals after amplification, for converting the amplified signals into acoustical signals and for directing the acoustical signals towards a user's eardrum or other sound-sensitive organ, and an additional signal path the output signals from which are delivered to the input of a component connected in the main signal path, said output signals being substantially equal in amplitude to signals received by said electro-acoustical transducer, and in such a relative phase as to substantially cancel the part of the received signals originating from the transducer upon or before being delivered to the input of said transducer, said additional signal path comprising:

a sound-input means, disposed at least near to a location remote from said microphone in a preferred sound transmission path between said transducer and said microphone, for receiving sound at least near said location and for producing a corresponding output, the transmission time along said additional signal path being substantially equal to the transmission time along said preferred path for sound transmitted from said location to said microphone; and means for delaying said output of said sound-input means and for controlling the magnitude of said output of said sound-input means, so as to ensure cancellation of said part of said received signals.

2. A hearing aid according to claim 1 wherein said sound-input means of said additional path comprises a tube leading from said location to an acoustical input of said microphone for causing the generation of signals opposite in phase to the signals generated by said microphone in response to said ambient sound.

3. A hearing aid according to claim 2 wherein said microphone includes a front cavity and a rear cavity so that sound received in the two cavities produces signals of opposite phase at the output of the first microphone, and wherein one said cavity is acoustically connected to the surrounding atmosphere and the other said cavity is acoustically connected to the output end of said tube.

4. A hearing aid according to claim 2 wherein the output end of said tube is provided with an acoustical impedance-matching element placed in an aperture in the wall of said tube.

5. A hearing aid according to claim 4 wherein said impedance-matching element comprises an acoustical resistance.

6. a hearing aid according to claim 2 wherein said tube includes an adjustable acoustical valve.

7. A hearing aid according to claim 2 wherein the hearing aid comprises an in-the-ear hearing aid for placement in the external meatus of a human ear, said microphone being placed with a sound-receiving duct or cavity substantially directly connected to the atmosphere, said electro-acoustical transducer being placed with a sound producing output duct or cavity directed inwardly in said external meatus, said in-the-ear hearing aid including a vent canal extending through the body of the hearing aid and connecting the portion of said meatus lying interior of the hearing aid to the atmosphere, and said location being located in said vent canal.

8. In a hearing aid comprising a first microphone for receiving ambient sound and for producing, on a main signal path, electrical signals corresponding thereto, an amplifier for receiving and amplifying the electrical signals produced by said microphone to produce amplified signals, an electro-acoustical transducer for receiving the amplified signals, for converting the amplified signals into acoustical signals and for directing the acoustical signals towards a user's eardrum or other sound-sensitive organ, and an additional signal path the output signals from which are delivered to the input of said amplifier, said output signals being substantially equal in amplitude to signals received by said amplifier from said first microphone and caused by sound propagated from said electro-acoustical transducer and being in such a relative phase as to substantially cancel the part of received signals originating from said transducer at least near to said input, said additional signal path comprising:

a second microphone, disposed at least near to a location remote from said first microphone in a preferred sound transmission path between said transducer and said microphone, for receiving sound at least near said location and for producing a corresponding output, the transmission time along said additional signal path being substantially equal to the transmission time along said preferred path for sound transmitted from said location to said first microphone; and means, comprising an adjustable attenuator and an adjustable signal delay device, for delaying said output of said second microphone and for controlling the magnitude of said output of said second microphone so as to ensure cancellation of said part of said received signals.

9. A hearing aid according to claim 8 wherein said hearing aid includes a vent canal for venting sound to the ambient and said location is in said vent canal.

10. In a hearing aid comprising a microphone for receiving ambient sound and for producing, on a main signal path, electrical signals corresponding thereto, an amplifier for receiving and amplifying the electrical signals produced by said microphone so as to produce amplified signals, an electro-acoustical transducer for receiving said amplified signals, for converting said amplified signals into acoustical signals and for directing the acoustical signals towards a user's eardrum or other sound-sensitive organ, and an additional signal path the output signals from which are delivered to an input of said microphone, said output signals being substantially equal in amplitude to signals received by said electro-acoustical transducer and in such a relative phase as to substantially cancel the part of the received signals originating from the transducer upon or before being delivered to the input of said transducer, said additional signal path further comprising:

a sound-input means, disposed at least near to a location remote from said microphone in a preferred sound transmission path between said transducer and said microphone, for receiving sound at least near said location and for producing a corresponding output, the transmission time along said additional signal path being substantially equal to the transmission time along said preferred path for sound transmitted from said location to said microphone; and means for delaying said output of said sound-input means and for controlling the magnitude of said output of said sound-input means so as to ensure cancellation of said part of said received signals.

11. A hearing aid according to claim 10 wherein said hearing aid includes a vent canal for venting sound to the ambient and said location is in said vent canal.

* * * * *